US007773930B2

(12) United States Patent
Shin et al.

(10) Patent No.: US 7,773,930 B2
(45) Date of Patent: Aug. 10, 2010

(54) FIXING DEVICE AND IMAGE FORMING APPARATUS HAVING THE SAME

(75) Inventors: Su-ho Shin, Seongnam-si (KR); Hwan-guem Kim, Seoul (KR); Dong-jin Seol, Suwon-si (KR); Dong-woo Lee, Seoul (KR); Tae-gyu Kim, Hwaseong-si (KR); Chang-hoon Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 419 days.

(21) Appl. No.: 11/839,029

(22) Filed: Aug. 15, 2007

(65) Prior Publication Data

US 2008/0247789 A1 Oct. 9, 2008

(30) Foreign Application Priority Data

Apr. 4, 2007 (KR) ..... 10-2007-0033292

(51) Int. Cl.
*G03G 15/20* (2006.01)

(52) U.S. Cl. ..... 399/329

(58) Field of Classification Search ..... 399/107, 399/122, 320, 328, 329; 219/216, 619
See application file for complete search history.

(56) References Cited

U.S. PATENT DOCUMENTS

| | | | | |
|---|---|---|---|---|
| 6,782,233 | B2 * | 8/2004 | Condello et al. | 399/329 |
| 7,427,727 | B2 * | 9/2008 | Koide et al. | 219/216 |
| 7,515,858 | B2 * | 4/2009 | Tamemasa | 399/333 |

FOREIGN PATENT DOCUMENTS

| | | |
|---|---|---|
| JP | 10-254270 | 9/1998 |
| JP | 2006-78578 | 3/2006 |

OTHER PUBLICATIONS

Korean Office Action dated Mar. 19, 2008 issued in KR 2007-33292.

* cited by examiner

*Primary Examiner*—Hoan Tran
(74) *Attorney, Agent, or Firm*—Stanzione & Kim, LLP

(57) ABSTRACT

A fixing device includes a fixing roller, a fixing belt which is made to rotate by a rotation force received from the fixing roller, a nip forming unit to form a nip zone at a contact area between the fixing roller and the fixing belt, and a first heating unit, which is separated from the nip zone, to apply heat to the fixing belt. The nip zone and the heating unit are separated, so that the heating unit can be prevented from being broken as a result of the pressurization and thermal deformation.

29 Claims, 7 Drawing Sheets

FIXING DEVICE AND IMAGE FORMING APPARATUS HAVING THE SAME

CROSS-REFERENCE TO RELATED APPLICATIONS

This application claims priority under 35 U.S.C. §119(a) of Korean Patent Application No. 10-2007-0033292, filed on Apr. 4, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a fixing device that fixes a toner image onto a printing medium, and an image forming apparatus having the fixing device.

2. Description of the Related Art

Image forming apparatuses, such as printers, copiers, scanners, multi-function machines, and the like, include fixing devices which fix developer images, such as toner images, which are transferred onto sheets of paper by transferring devices, which are widely known to those skilled in the art.

In order to meet the recent demand for high-speed image forming apparatuses, the ability to rapidly increase a temperature and improved fixing properties are required in fixing devices. In order to rapidly increase the temperature, a thermal capacity of heating units in fixing devices needs to be reduced so a period of time required to raise the temperature can be reduced. Additionally, in order to improve fixing properties thereof, there is a need for a structure in which a width of a nip zone may be increased and pressure may effectively act on toner images so that heat from heating units can be effectively transferred to toner images.

FIGS. 1A and 1B are sectional views schematically illustrating conventional fixing devices. FIG. 1A illustrates a conventional roller-type fixing device, and FIG. 1B illustrates a conventional belt-type fixing device.

The conventional roller-type fixing device of FIG. 1A includes a pressing roller 10 and a heating roller 20 which rotate while tightly in contact with each other, and a heating unit 30, for example a heater, which is mounted in the heating roller 20.

The conventional roller-type fixing device configured as described above applies heat and pressure onto a non-fixed toner image T transferred onto a surface of a sheet of paper P by a transferring device known to those skilled in the art while the sheet of paper P passes through a nip zone N formed by pressure contact between the pressing roller 10 and the heating roller 20, which rotate in contact with each other, and then fuses the toner image onto the sheet of paper P. The conventional roller-type fixing device provides benefits for high-speed printing, because the temperature decrease when feeding sheets of paper is relatively small. However, since the heating roller 20 has a large thermal capacity and applies heat not only to the nip zone N but also to the entire surface of the heating roller 20, a long period of time is required to raise the temperature. Additionally, the nip zone N is formed in a contact area between the pressing roller 10 and the fixing belt 20, and thus the width of the nip zone N may be reduced, making difficult to implement the shape of the nip zone N in a variety of forms.

Referring to FIG. 1B, the conventional belt-type fixing device includes a pressing roller 10, a fixing belt 40 which is made to rotate by a rotation force transferred from the pressing roller 10, a guide member 50, which is mounted inside the fixing belt 40, to guide the rotation of the fixing belt 40, and a heating unit 60, which is mounted on the guide member 50, to heat a nip zone N of the fixing belt 40.

In the conventional belt-type fixing device configured as described above, since the heating unit 60 has a small thermal capacity and applies heat to only the nip zone N, it is possible for the period of time required to raise the temperature to be less than in the conventional roller-type fixing device of FIG. 1A. Additionally, a width of the heating unit 60 is increased, and thus it is possible to increase the width of the nip zone N. However, as the heating unit 60 simultaneously applies heat and pressure to the nip zone N to fix the toner image T on the printing medium P, the pressurizing force may be limited by the durability of the heating unit 60. Therefore, a great pressurizing force does not act on the nip zone N, and the pressurizing force may not be sufficient to fix the image. Additionally, if an excessive pressurizing force is applied to the nip zone N in order to improve the fixing properties, the heating unit 60 can be broken due to the pressurization and thermal deformation.

SUMMARY OF THE INVENTION

The present general inventive concept provides a fixing device in which a nip zone and a heating unit are separated, so that it is possible to prevent the heating unit from being damaged due to pressurization and thermal deformation.

The present general inventive concept also provides a fixing device in which an effective width of a nip zone can be increased and the period of time required to raise the temperature can be reduced, so that the fixing properties can be improved and printing can be performed at high speed.

The present general inventive concept provides an image forming apparatus having the above-described fixing devices.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a fixing device including a fixing roller, a fixing belt to rotate by a rotation force received from the fixing roller, a nip forming unit to form a nip zone at a contact area between the fixing roller and the fixing belt, and a first heating unit, which is separated from the nip zone, to apply heat to the fixing belt.

The first heating unit may be mounted at a position adjacent to an outside surface or an inside surface of the fixing belt.

The first heating unit may be disposed adjacent to an inlet side of the nip zone.

The first heating unit may be one of a lamp heater and a plate-shaped heating element.

The fixing device may further include a supporting roller to support the fixing belt, the supporting roller being opposite the first heating unit.

The supporting roller may be mounted to be in contact with the outside surface or the inside surface of the fixing belt.

The first heating unit may be a heating roller to rotate opposite the supporting roller.

The heating roller may be mounted to be in contact with the inside surface of the fixing belt.

The fixing device may further include a guide member to support the first heating unit and the nip forming unit, the guide member being mounted inside the fixing belt so as to guide the rotation of the fixing belt.

The nip forming unit may include an elastic body with a predetermined elasticity, for example a nip spring.

The nip spring may be made of a metallic material.

The nip spring may be elastically deformed so as to have a curved surface in order to fit on an outside surface of the fixing roller.

The nip spring may be formed so that the inlet side of the nip zone may have a radius of curvature greater than that of an outlet side of the nip zone.

At least one projection protruding towards the fixing roller may be formed on a bottom surface of the nip spring.

The nip spring may be formed so that a surface of the inlet side of the nip zone and a surface of the outlet side of the nip zone may be asymmetrical.

The nip spring may be formed so that the thickness of the outlet side of the nip zone may be thicker than that of the inlet side of the nip zone.

The nip spring may be formed so that the inlet side of the nip zone may have more bends than the outlet side of the nip zone.

The nip forming unit may include a supporting member to support the nip spring.

The fixing device may further include a second heating unit to apply heat to the nip zone of the fixing belt.

The second heating unit may be mounted on one or both of the inside and the outside of the nip spring.

The second heating unit may be one of a lamp heater and a plate-shaped heating element.

The fixing roller may be a pressing roller.

The foregoing and/or other aspects and utilities of the present general inventive concept may also be achieved by providing a fixing device including a pressing roller, a fixing belt to be in contact with the pressing roller to form a nip zone at a contact area between the fixing belt and the pressing roller, a heating roller to apply heat to a predetermined area of the fixing belt, except for the nip zone, and a supporting roller to support the fixing belt, the supporting roller being opposite the heating roller.

The foregoing and/or other aspects and utilities of the present general inventive concept may also be achieved by providing an image forming apparatus including a photoconductive medium, a developing device to attach a developer onto an electrostatic latent image on the photoconductive medium and to develop the electrostatic latent image, a transferring device to transfer an image developed on the photosensitive medium by the developing device to a printing medium, and a fixing device, as described above, to fix the image transferred to the printing medium.

The foregoing and/or other aspects and utilities of the present general inventive concept may also be achieved by providing a fixing device usable with an image forming apparatus, including a fixing roller, a fixing belt having a first portion to form a nip zone with the fixing roller, and a heating unit disposed to correspond to a second portion of the fixing portion other than the first portion to apply heat to the fixing belt.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
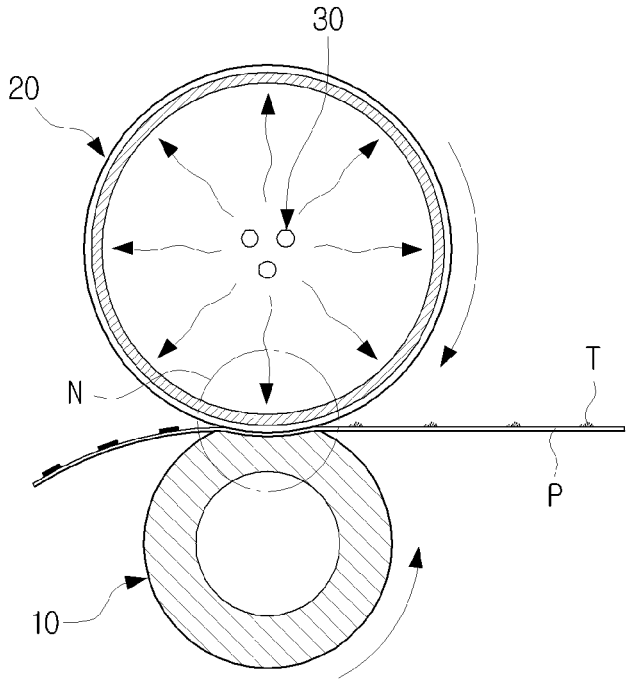
FIG. 1A (PRIOR ART)
FIGS. 1A and 1B are sectional views schematically illustrating conventional fixing devices.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

Figure 2:
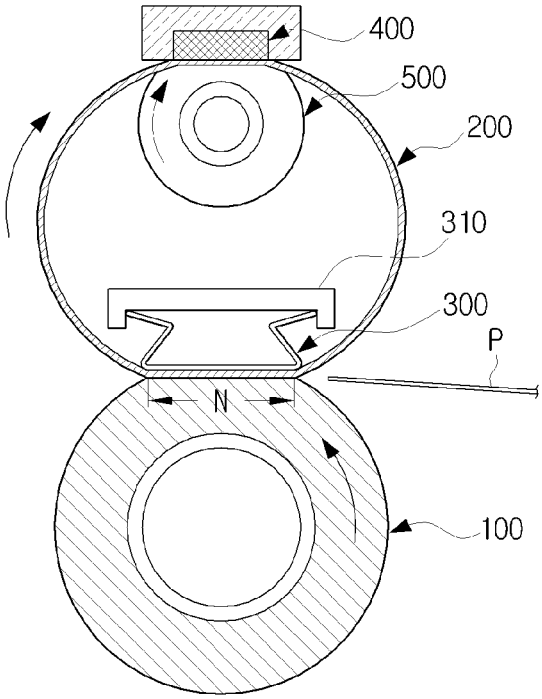
FIG. 2 is a sectional view schematically illustrating a fixing device usable with an image forming apparatus according to an exemplary embodiment of the present general inventive concept.
Figure 3:
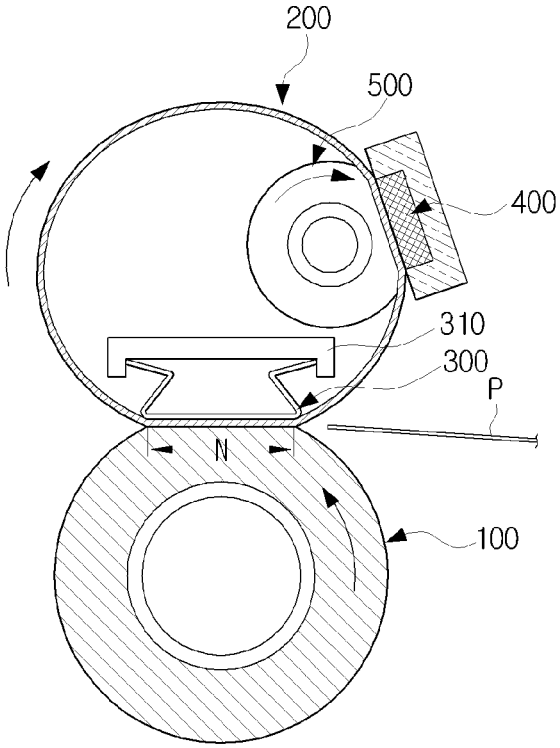
FIG. 3 is a sectional view illustrating a position of a heating unit of the fixing device of FIG. 2.
Figure 4:
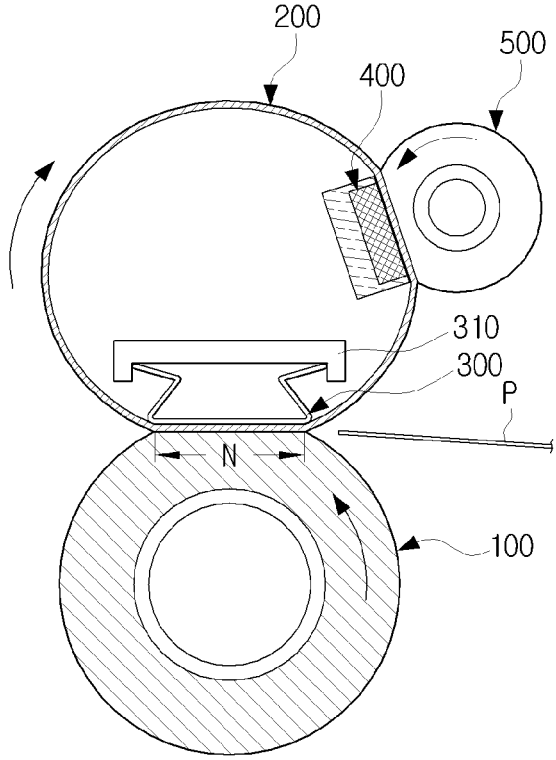
FIG. 4 is a sectional view illustrating positions of a heating unit and a supporting roller of the fixing device of FIG. 3.
Figure 5:
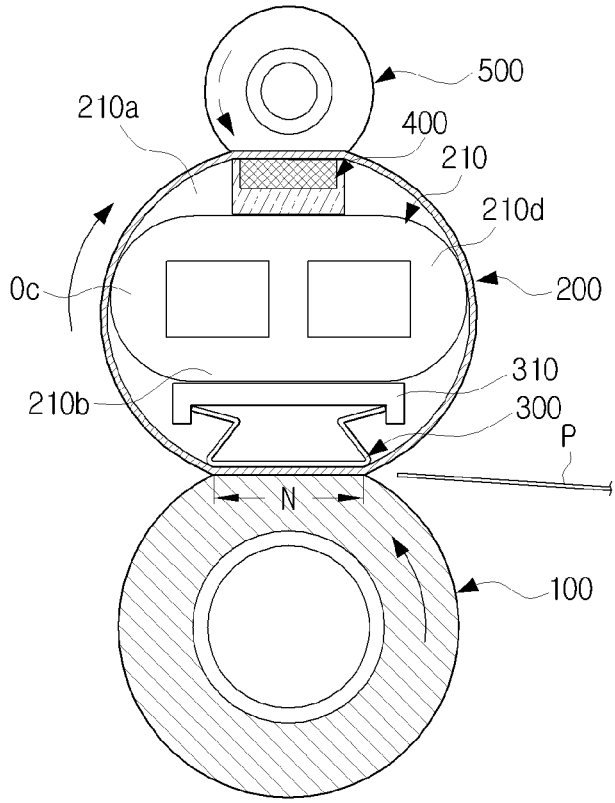
FIG. 5 is a sectional view illustrating a guide member and a fixing belt of the fixing device of FIG. 2.

FIG. 2 is a sectional view schematically illustrating a fixing device usable with an image forming apparatus according to an exemplary embodiment of the present general inventive concept, FIG. 3 is a sectional view illustrating a position of a heating unit illustrated in FIG. 2, FIG. 4 is a sectional view illustrating positions of a heating unit and a supporting roller illustrated in FIG. 3, and FIG. 5 is a sectional view illustrating a guide member mounted in a fixing belt in the fixing device of FIG. 2.

As illustrated in FIGS. 2 through 5, the fixing device according to the exemplary embodiment of the present general inventive concept includes a fixing roller 100, a fixing belt 200, a nip forming unit 300, a first heating unit 400 and a supporting roller 500.

The fixing roller 100 may be a pressing roller 100 (hereinafter, indicated by reference numeral 100) and may receive a driving force and rotate thereby, in order to press and fix a toner image onto a printing medium, for example, a sheet of paper P. The pressing roller 100 may be long and cylindrical in shape.

The fixing belt 200 may receive a rotation force from the pressing roller 100 and rotate thereby, and a nip zone N may be formed between the pressing roller 100 and the fixing belt 200. The nip N refers to an area in which the sheet of paper P is held between a contact area of the pressing roller 100 and the fixing belt 200. The fixing belt 200 may be made of a thermally resistant material, and may be shaped as a belt, with a width corresponding to a length of the pressing roller 100 in a rotational direction of the pressing roller 100. Additionally, the fixing belt 200 may have a regular elastic force in order to rotate smoothly. A constant pressurizing force necessary for fixing a toner image onto the sheet of paper P may exist between the pressing roller 100 and the fixing belt 200. The fixing belt 200 rotates together with the pressing roller 100 as described in accordance with the exemplary embodiment of FIG. 2, but a separate driving device may be used to rotate the fixing belt 200 instead of the pressing roller 100.

The nip forming unit 300 may support the fixing belt 200 so that a nip zone N can be formed in a contact area between the pressing roller 100 and the fixing belt 200. The nip forming unit 300 may be formed of an elastic body with a predetermined elasticity, for example a nip spring 300 (hereinafter, indicated by reference numeral 300), so that a pressing force acting on the pressing roller 100 can be adjusted. The nip spring 300 may be made of a metallic material, and a leading end thereof may be fixed and supported by a supporting member 310.

Figure 8:
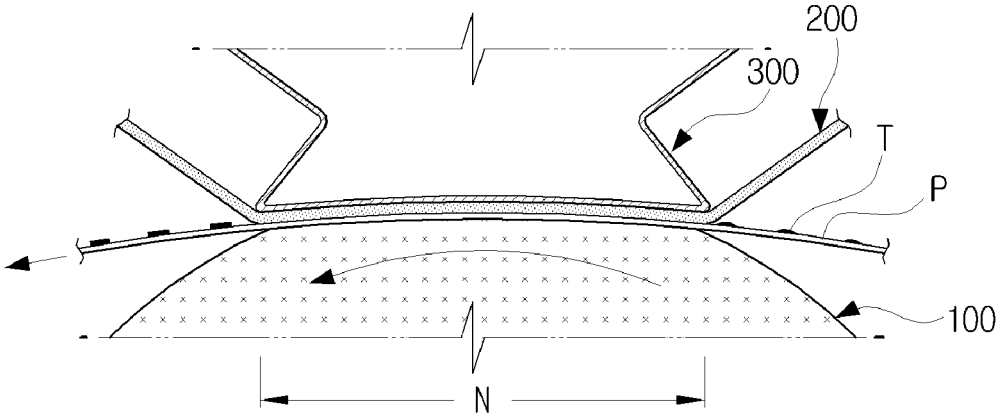
FIG. 8 is a sectional view illustrating a shape of an elastically deformed nip spring of the fixing device of FIGS. 2 and 7.
Figure 9A:
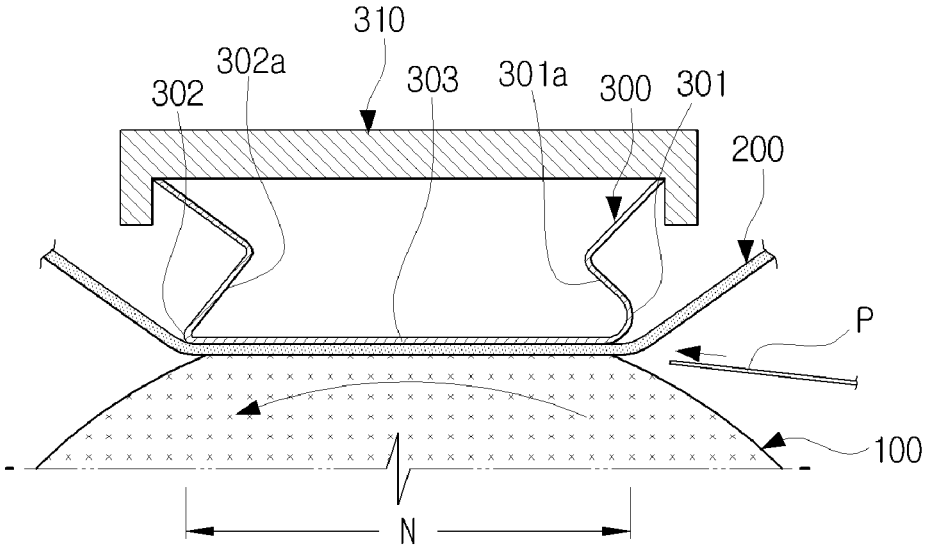
FIGS. 9A to 9D are sectional views illustrating various examples of a nip spring of the fixing device of FIGS. 2 and 7.

As illustrated in FIG. 8, the nip spring 300 may be elastically deformed so that one side surface thereof has a curved surface to correspond to an outside surface of the pressing roller 100. Additionally, the nip spring 300 may be deformed in various shapes in order to easily feed and discharge sheets of paper. For example, in the nip spring 300 illustrated in FIG. 9A, an inlet side 301 of the nip zone N may have a radius of curvature greater than that of an outlet side 302 of the nip zone N. Thus, a sheet of paper P can easily enter the inlet side 301 of the nip zone N and can also be easily discharged since the sheets of paper P are separated at the outlet side 302 of the nip zone N. That is, the inlet side 301 is formed with an inlet side plate 301*a* and a portion of a nip plate 303, and the outlet side 302 is formed with an outlet side plate 302*a* and another portion of the nip plate 303. An angle or a radius of curvature formed between the inlet side plate 301*a* and the portion of the nip plate 303 may be greater than an angle or a radius of curvature formed between the outlet side plate 302*a* and the another portion of the nip plate 303.

Figure 9B:
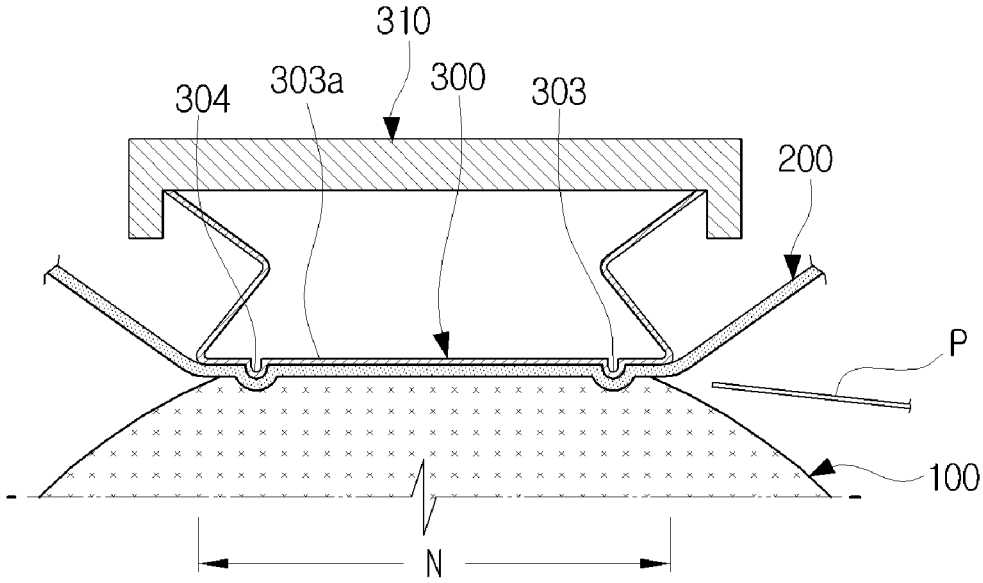
Figure 9C:
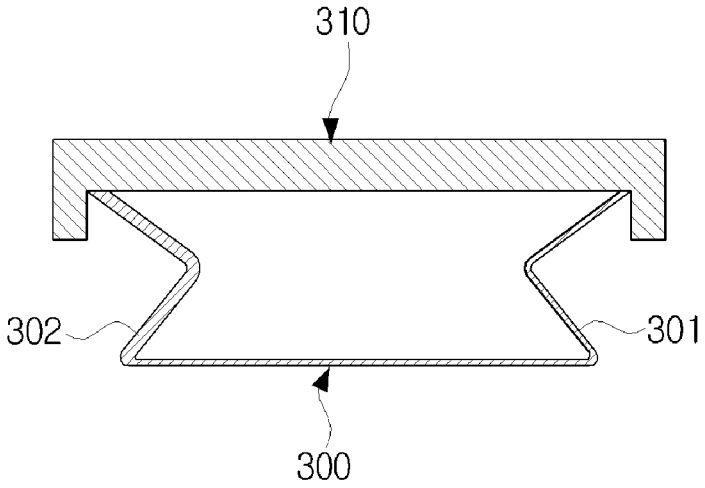
Figure 9D:
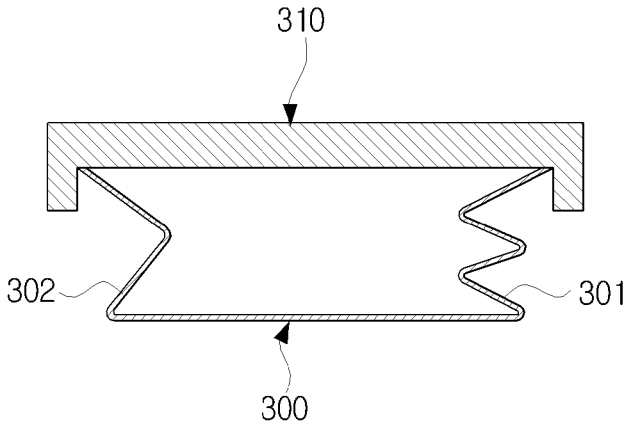

Additionally, as illustrated in FIG. 9B, at least one projection 303 and 304 protruding towards the pressing roller 100 may be formed on a bottom surface of the nip spring 300 that is, the nip plate 303*a*, so that the sheets of paper P can be easily fed and discharged and also can be prevented from jamming. Furthermore, the nip spring 300 can be formed so that a surface of the inlet side 301 and a surface of the outlet side 302 can be asymmetrical. For example, the nip spring 300 may be formed so that the thickness of the outlet side 302 can be thicker than that of the inlet side 301 as illustrated in FIG. 9C, or so that the inlet side 301 can have more bends than the outlet side 302 as illustrated in FIG. 9D. Accordingly, the outlet side 302 can have an elastic modulus greater than that of the inlet side 301, and thus it is possible to easily perform fixing by increasing the pressurizing force on the outlet side 302.

Figure 7:
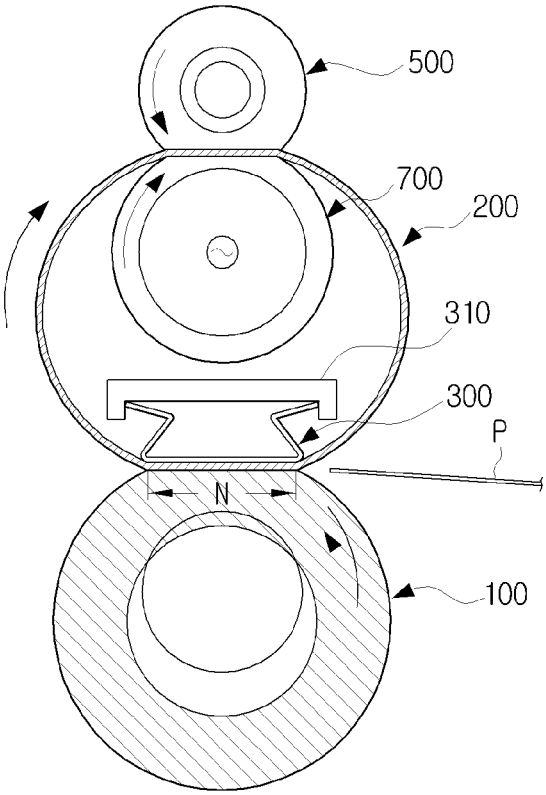
FIG. 7 is a sectional view schematically illustrating a fixing device usable with an image forming apparatus according to an exemplary embodiment of the present general inventive concept.

The first heating unit 400 may be mounted at a position adjacent to an outside surface or an inside surface of the fixing belt 200, except on the nip zone N, may receive a power source from an external power supply, and may simultaneously generate and apply heat to the fixing belt 200. The first heating unit 400 may be variously implemented as a lamp heater, a plate-shaped heating element, or the like. A heating roller 700 having a heating source disposed therein as illustrated in FIG. 7 may be used instead of the first heating unit 400. The first heating unit 400 may be disposed adjacent to the inlet side 301 of the nip zone N in order to minimize a heat loss occurring during rotation of the fixing belt 200, as illustrated in FIG. 3. Although not illustrated in the drawings, the fixing device may include a temperature sensor to measure the temperature of the first heating unit 400 or the heating roller 700, and a temperature controller to control the temperature of the first heating unit 400 or the heating roller 700 which is measured by the temperature sensor.

The supporting roller 500 may be mounted opposite to the first heating unit 400 in order to support the fixing belt 200, and may be generally long and cylindrical in shape. The supporting roller 500 may pivot in contact with an outer or inside surface of the fixing belt 200, or the supporting roller 500 may be rotated by the fixing belt or a separate driving device. The positions of the first heating unit 400 and supporting roller 500 may be swapped with each other with respect to the fixing belt 200. For example, referring to FIG. 3, the first heating unit 400 may be disposed on the outside surface of the fixing belt 200 and the supporting roller 500 may be disposed on the inside surface of the fixing belt 200, that is, opposite to the first heating unit 400 with respect to the fixing belt 200. Alternatively, referring to FIG. 4, the first heating unit 400 may be disposed on the inside surface of the fixing belt 200 and the supporting roller 500 may be disposed on the outside surface of the fixing belt 200, that is, opposite to the first heating unit 400 with respect to the fixing belt 200.

As illustrated in FIG. 5, if the fixing device according to the exemplary embodiment of FIG. 2 includes the first heating unit 400 mounted to correspond to the inside surface of the fixing belt 200, a guide member 210 may be mounted inside the fixing belt 200 to guide the rotation of the fixing belt 200, and the first heating unit 400 and the supporting member 310 with the nip spring 300 are simultaneously supported and fixed on the guide member 210. The guide member 210 may have an elongated shape, and may be longitudinally mounted within the fixing belt 200. The guide member 210 may be variously formed to have a cylindrical or elliptical shape, for example. When the guide member 210 has the elliptical shape, an upper surface 210*a* and a lower surface 210*b* thereof can fix and support the first heating unit 400 and the nip spring 300, respectively, and both side surfaces 210*c* and 210*d* thereof also can be in contact with the inside surface of the fixing belt 200 to guide the rotation of the fixing belt 200.

The fixing device configured in accordance with the exemplary embodiment described above applies heat and pressure onto a non-fixed toner image T (referring to FIG. 8) transferred onto a surface of a sheet of paper P by a transferring device known to those skilled in the art, while the sheet of paper P passes through a nip zone N formed by pressure contact between the pressing roller 100 and the fixing belt 200 which rotate in contact with each other, and then fuses the toner image T onto the sheet of paper P. The nip spring 300 may elastically press the nip zone N of the fixing belt 200 towards the pressing roller 100, and the first heating unit 400 is disposed opposite to the supporting roller 500 with respect to the fixing belt 200 to heat the fixing belt 200, except for the nip zone N. In other words, the nip zone N is separated from the first heating unit 400, and accordingly a high pressure may be applied to the nip zone N, and a low pressure may be applied to the first heating unit 400 in order to heat the fixing belt 200. Accordingly, the first heating unit 400 may be in close contact with the supporting roller 500 using a pressurizing force as low as can be used to heat the fixing belt 200, and thus it is possible to prevent the first heating unit 400 from being broken due to the pressurization. Additionally, as the first heating unit 400 is not mounted in the nip zone N, the great pressurizing force may be applied to the nip zone N to increase the effective width of the nip zone N. Therefore, the pressure may act on the toner image T of the sheet of paper P, passing through the nip zone N with an increased effective width, for a long period of time, so fixing properties can be improved and the toner image can be readily fixed even during high-speed printing.

Additionally, the nip spring 300 may be elastically deformed so as to have a curved surface to fit on or correspond to an outside surface of the pressing roller 100, and thus it is possible to increase adhesiveness between the nip zone N and the pressing roller 100 in order to fix the toner image.

Furthermore, the elastic properties may vary by modifying the shape of the nip spring 300, and therefore it is possible to easily feed and discharge the sheets of paper according to the shape of the nip zone N, and also to improve the fixing properties.

Figure 6:
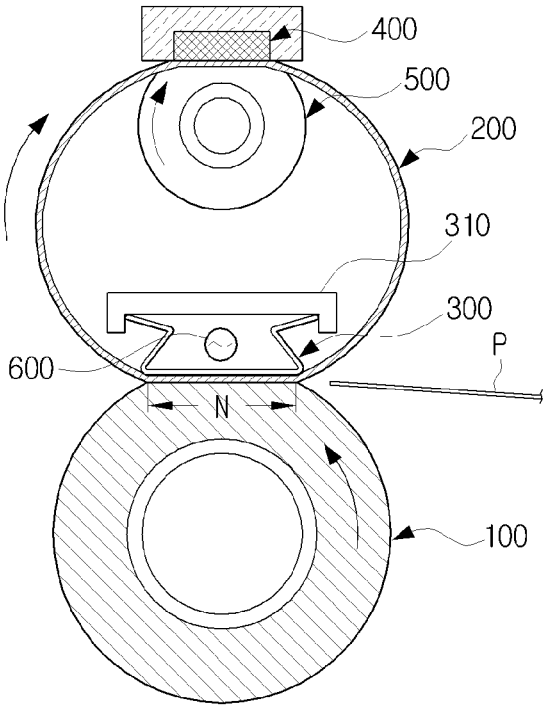
FIG. 6 is a sectional view schematically illustrating a fixing device usable with an image forming apparatus according to an exemplary embodiment of the present general inventive concept.

FIG. 6 is a sectional view schematically illustrating a fixing device according to an exemplary embodiment of the present general inventive concept.

The configuration of the fixing device according to the exemplary embodiment described with reference to FIG. 6 is the same as that of the fixing device according to the exemplary embodiment described with reference to FIGS. 2 to 5, except that the fixing device of FIG. 6 further includes a second heating unit 600 to heat the nip zone N of the fixing belt 200. Accordingly, the same reference numerals have been used for the elements which perform the same functions as those of the first exemplary embodiment of the present general inventive concept described with reference to FIGS. 2 to 5, and more detailed descriptions thereof are omitted.

The second heating unit 600 may be mounted on one or both of the inside and the outside of the nip spring 300. It is possible that the second heating unit 600 may mounted inside the nip spring 300. The second heating unit 600 may be one of a lamp heater and a plate-shaped heating element.

The operation of the fixing device according to the exemplary embodiment of FIG. 6 is the same as that of the fixing device according to the exemplary embodiment of FIGS. 2 through 5. However, the fixing device of FIG. 6 further includes the second heating unit 600 mounted inside the nip spring 300, and thus the nip zone N of the fixing belt 200 and neighboring areas may be locally heated, thereby increasing a temperature rising rate. The nip spring 300 may transfer heat exerted by the second heating unit 600 to the nip zone N of the fixing belt 200, and may protect the second heating unit 600 mounted inside the nip spring 300, which is made of an elastic body, when heat and pressure are applied to the nip zone N.

FIG. 7 is a sectional view schematically illustrating a fixing device according to an exemplary embodiment of the present general inventive concept.

The configuration of the fixing device according to the exemplary embodiment of described with reference to FIG. 7 is the same as that of the fixing device according to the exemplary embodiment described with reference to FIGS. 2 to 5, except that the heating roller 700 is used as the first heating unit 400 and/or the second heating unit 600. Since the same reference numerals have been used for the elements which perform the same functions as those of the exemplary embodiment described with reference to FIGS. 2 to 5, more detailed descriptions thereof are omitted.

The heating roller 700 may rotate in a direction opposite to the rotating direction of the supporting roller 500, and may be mounted in contact with the inner or outside surfaces of the fixing belt 200. A lamp heater, a plate-shaped heating element or the like may be included in the heating roller 700, and accordingly the heating roller 700 may receive a power source from the outside, and may generate heat. Although not illustrated in FIG. 7, a lamp heater, a plate-shaped heating element or the like may also be included in the interior (desirably) or the exterior of the nip spring 300.

Figure 1B:
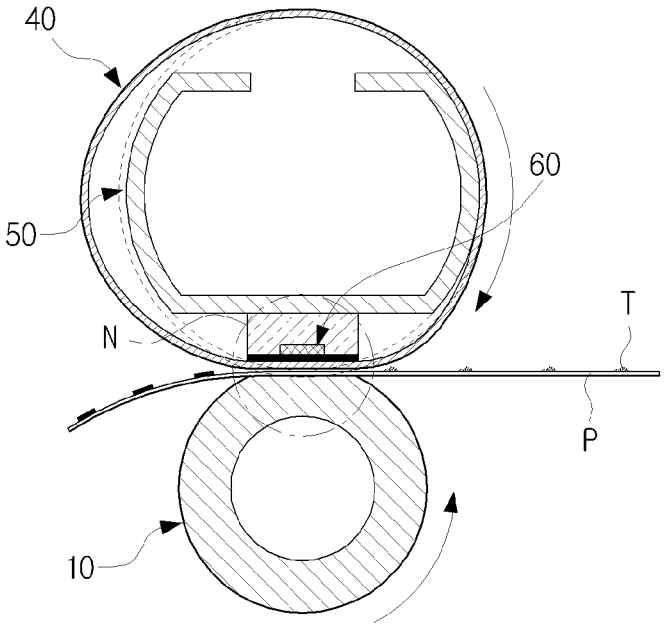
FIG. 1B (PRIOR ART)

The operation of the fixing device according to the third exemplary embodiment of FIG. 7 is the same as that of the fixing device according to the exemplary embodiment of FIGS. 2 through 5. However, a diameter of the heating roller 700 may be less than that of the conventional heating roller 20 (referring to FIG. 1) when applying heat and pressure, because a pressurizing force low enough that only the fixing belt 200 can be heated allows the supporting roller 500 to be in close contact with the heating roller 700. Therefore, the heating roller 700 may have a small thermal capacity, thereby increasing the rate of temperature increase compared to the conventional art.

Figure 10:
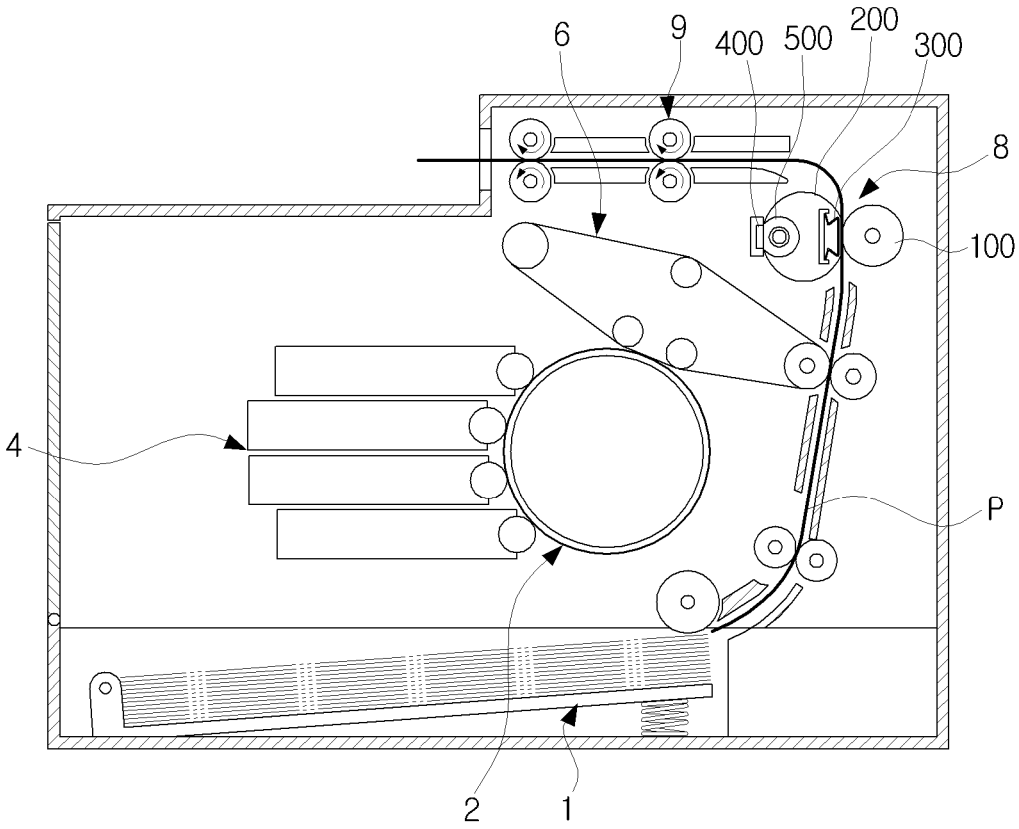
FIG. 10 is an exemplary view schematically illustrating an image forming apparatus including a fixing device according to an exemplary embodiment of the present general inventive concept.

As illustrated in FIG. 10, an image forming apparatus according to exemplary embodiments of the present general inventive concept includes a feeding device 1, a photoconductive medium 2, a developing device 4 to attach a developer onto an electrostatic latent image on the photoconductive medium 2 and to develop the electrostatic latent image, a transferring device 6 to transfer an image developed on the photosensitive medium 2 by the developing device 4 to a printing medium P, a fixing device 8, as configured in accordance with the exemplary embodiments described above, to fix the image transferred to the printing medium P; and a discharging device 9. The feeding device 1, the photoconductive medium 2, the developing device 4, the transferring device 6 and the discharging device 9 are known to those skilled in the art, so more detailed descriptions thereof are omitted.

As described above, according to exemplary embodiments of the present general inventive concept, if a nip zone and a heating unit are separated, the heating unit can be prevented from being broken as a result of the pressurization and thermal deformation.

Additionally, since a large pressurizing force may be applied to the nip zone based on the pressurizing force generally used in image fixing, the effective width of the nip zone can be increased, and the fixing properties of the nip zone can also be improved.

Furthermore, initial preheating of the nip zone can be rapidly completed by locally heating the nip zone, so it is possible to reduce the period of time required to raise the temperature and the high-speed printing rate can be increased accordingly.

Moreover, the nip spring may be elastically deformed so as to have a curved surface in order to fit on an outside surface of the pressing roller, and thus the pressure can be uniformly distributed in the nip zone and it is possible to increase adhesiveness between the nip zone and the pressing roller in order to fix the toner image.

In addition, the elastic properties may be altered by modifying the shape of the nip spring 300, and therefore the shape of the nip zone N can be adjusted so that it is possible to easily feed and discharge the sheets of paper, and also to improve the fixing properties.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A fixing device usable with an image forming apparatus, comprising:

a fixing roller;

a fixing belt which is made to rotate by a rotation force received from the fixing roller;

a nip forming unit to form a nip zone at a contact area between the fixing roller and the fixing belt; and a first heating unit which is separated from the nip zone to apply heat to the fixing belt, wherein the first heating unit is mounted adjacent to a surface of the fixing belt.

2. The fixing device as claimed in claim 1, wherein the first heating unit is mounted at a position adjacent to one of an outside surface and an inside surface of the fixing belt.

3. The fixing device as claimed in claim 2, wherein the first heating unit is disposed adjacent to an inlet side of the nip zone.

4. The fixing device as claimed in claim 1, wherein the first heating unit is one of a lamp heater and a plate-shaped heating element.

5. The fixing device as claimed in claim 1, further comprising:

a supporting roller disposed opposite to the first heating unit with respect to the fixing belt to support the fixing belt with respect to the first heating unit.

6. The fixing device as claimed in claim 5, wherein the supporting roller is mounted to be in contact with the outside surface or the inside surface of the fixing belt.

7. The fixing device as claimed in claim 5, wherein the first heating unit is a heating roller to rotate opposite the supporting roller.

8. The fixing device as claimed in claim 7, wherein the heating roller is mounted to be in contact with an inside surface of the fixing belt.

9. The fixing device as claimed in claim 1, further comprising:

a guide member mounted inside the fixing belt to guide the rotation of the fixing belt and to support the first heating unit and the nip forming unit.

10. The fixing device as claimed in claim 1, wherein the nip forming unit comprises an elastic body with a predetermined elasticity.

11. The fixing device as claimed in claim 10, wherein the nip forming unit comprises a nip spring.

12. The fixing device as claimed in claim 11, wherein the nip spring is made of a metallic material.

13. The fixing device as claimed in claim 11, wherein the nip spring is elastically deformed so as to have a curved surface in order to fit on an outside surface of the fixing roller.

14. The fixing device as claimed in claim 11, wherein the nip spring is formed so that an inlet side of the nip zone has a radius of curvature greater than that of an outlet side of the nip zone.

15. The fixing device as claimed in claim 11, wherein the nip spring comprises at least one projection formed on a bottom surface thereof to protrude towards the fixing roller.

16. The fixing device as claimed in claim 11, wherein the nip spring is formed such that a surface of an inlet side of the nip zone and a surface of an outlet side of the nip zone are asymmetrical.

17. The fixing device as claimed in claim 16, wherein the nip spring comprises a portion disposed at the outlet side of the nip zone to have a thickness thicker than that of an inlet side of the nip zone.

18. The fixing device as claimed in claim 16, wherein the nip spring has a first number of bent portions on the inlet side of the nip zone and a second number of bent portions on the outlet side of the nip zone.

19. The fixing device as claimed in claim 11, wherein the nip forming unit comprises a supporting member to support the nip spring.

20. The fixing device as claimed in claim 1, further comprising:

a second heating unit to apply heat to the nip zone of the fixing belt.

21. The fixing device as claimed in claim 20, wherein the nip forming unit comprises a nip spring and the second heating unit is mounted on one or both of the inside and the outside of the nip spring.

22. The fixing device as claimed in claim 20, wherein the second heating unit is one of a lamp heater and a plate-shaped heating element.

23. The fixing device as claimed in claim 1, wherein the fixing roller is a pressing roller.

24. A fixing device usable with an image forming apparatus, comprising:

a fixing roller;

a fixing belt to be in contact with the fixing roller to form a nip zone at an area between the fixing belt and the fixing roller;

a heating roller disposed adjacent to a surface of the fixing belt on a position other than the nip zone to apply heat to the fixing belt; and a supporting roller disposed opposite to the heating roller with respect to the fixing belt to support the fixing belt.

25. A fixing device usable with an image forming apparatus, comprising:

a fixing roller;

a fixing belt to rotate by a rotation force received from the fixing roller;

a nip forming unit to form a nip zone between the fixing roller and the fixing belt;

a heating unit disposed at a separated position from the nip zone to apply heat to the fixing belt; and a supporting roller disposed adjacent to a surface of the fixing belt and opposite the heating unit with respect to the fixing belt to support the fixing belt.

26. An image forming apparatus comprising:

a photoconductive medium;

a developing device to attach a developer onto an electrostatic latent image on the photoconductive medium and to develop the electrostatic latent image;

a transferring device to transfer an image developed on the photosensitive medium by the developing device to a printing medium; and a fixing device to fix the image transferred to the printing medium, wherein the fixing device comprises:

a fixing roller;

a fixing belt which is made to rotate by a rotation force received from the fixing roller;

a nip forming unit to form a nip zone at a contact area between the fixing roller and the fixing belt; and a first heating unit which is separated from the nip zone and located adjacent to a surface of the fixing belt to apply heat to the fixing belt.

27. An image forming apparatus comprising:

a photoconductive medium;

a developing device to attach a developer onto an electrostatic latent image on the photoconductive medium and to develop the electrostatic latent image;

a transferring device to transfer an image developed on the photosensitive medium by the developing device to a printing medium; and a fixing device to fix the image transferred to the printing medium, wherein the fixing device comprises:

a pressing roller;

a fixing belt to be in contact with the pressing roller to form a nip zone at a contact area between the fixing belt and the pressing roller;

a heating roller to apply heat to the fixing belt, except for the nip zone; and a supporting roller disposed opposite to the heating roller with respect to the fixing belt to support the fixing belt, wherein the heating roller is mounted adjacent to an inside surface of the fixing belt.

28. An image forming apparatus comprising;

a photoconductive medium;

a developing device to attach a developer onto an electrostatic latent image on the photoconductive medium and to develop the electrostatic latent image;

a transferring device to transfer an image developed on the photosensitive medium by the developing device to a printing medium; and a fixing device to fix the image transferred to the printing medium, wherein the fixing device comprises:

a fixing roller;

a fixing belt to rotate by a rotation force received from the fixing roller;

a nip forming unit to form a nip zone between the fixing roller and the fixing belt;

a heating unit disposed at a separated position from the nip zone to apply heat to the fixing belt; and a supporting roller disposed opposite the heating unit with respect to the fixing belt to support the fixing belt.

29. A fixing device usable with an image forming apparatus, comprising:

a fixing roller;

a fixing belt having a first portion to form a nip zone with the fixing roller; and a heating unit disposed adjacent to a surface of the heating belt to correspond to a second portion of the fixing portion other than the first portion to apply heat to the fixing belt.

* * * * *